US007150668B2

(12) United States Patent
Kemp

(10) Patent No.: US 7,150,668 B2
(45) Date of Patent: Dec. 19, 2006

(54) BUOYANCY GARMENT

(75) Inventor: Brian Ernest Kemp, Beechmont (AU)

(73) Assignee: Aquasafe Australasia Pty Ltd., Queensland (AU)

( * ) Notice: Subject to any disclaimer, the term of this patent is extended or adjusted under 35 U.S.C. 154(b) by 0 days.

(21) Appl. No.: 10/505,877

(22) PCT Filed: Mar. 12, 2003

(86) PCT No.: PCT/AU03/00289

§ 371 (c)(1),
(2), (4) Date: Sep. 3, 2004

(87) PCT Pub. No.: WO03/075692

PCT Pub. Date: Sep. 18, 2003

(65) Prior Publication Data

US 2005/0101203 A1 May 12, 2005

(30) Foreign Application Priority Data

Mar. 13, 2002 (AU) ..... 2002100202

(51) Int. Cl.
*B63C 9/125* (2006.01)
*A41D 13/012* (2006.01)

(52) U.S. Cl. ..... 441/106; 441/107; 441/118

(58) Field of Classification Search ..... 441/88, 441/106–119; 2/DIG. 2, 67, 102, 103, 108, 2/456, 462–464, DIG. 3
See application file for complete search history.

(56) References Cited

U.S. PATENT DOCUMENTS

| | | | | |
|---|---|---|---|---|
| 1,428,151 | A | 9/1922 | Drew | |
| 1,504,249 | A * | 8/1924 | Klein | 2/70 |
| 1,723,402 | A * | 8/1929 | Browdy | 441/102 |
| 1,800,960 | A * | 4/1931 | Savard | 441/102 |
| 1,803,898 | A * | 5/1931 | Diamond | 441/102 |
| 1,868,210 | A * | 7/1932 | Lehmann | 441/115 |
| 2,425,206 | A * | 8/1947 | Ripley | 441/107 |
| 2,607,934 | A * | 8/1952 | Bailhe | 441/107 |
| 3,004,269 | A * | 10/1961 | Dillier | 441/98 |
| 3,019,459 | A * | 2/1962 | Ripley | 441/107 |
| 3,134,993 | A * | 6/1964 | McCoy | 441/102 |
| 3,199,128 | A * | 8/1965 | Nojd | 441/89 |
| 3,266,069 | A * | 8/1966 | O'Link | 441/107 |
| 3,441,963 | A * | 5/1969 | Steinthal | 441/107 |
| 4,097,947 | A * | 7/1978 | Kiefer | 441/116 |
| 4,767,371 | A * | 8/1988 | Jackson | 441/94 |
| 5,184,968 | A * | 2/1993 | Michalochick et al. | 441/116 |
| 5,603,648 | A | 2/1997 | Kea | |
| 5,839,933 | A | 11/1998 | Davis, Sr. et al. | |
| 6,231,411 | B1 | 5/2001 | Vinay | |

FOREIGN PATENT DOCUMENTS

| | | |
|---|---|---|
| CA | 1085235 | 9/1980 |
| EP | 23430 A1 * | 2/1981 |
| GB | 316454 | 8/1928 |
| GB | 2183554 | 6/1987 |
| GB | 2 261 590 | 11/1992 |

(Continued)

*Primary Examiner*—Ajay Vasudeva
(74) *Attorney, Agent, or Firm*—Hoffman, Wasson & Gitler, P.C.

(57) ABSTRACT

A clothing item such as a shirt is combined with a concealed and entrapped bladder which can be inflated in the event of an emergency. The shirt can be of fashionable appearance and the buoyance function disguised to make the buoyancy device more attractive to those who otherwise may be inclined to take risks on or in water.

13 Claims, 3 Drawing Sheets

FOREIGN PATENT DOCUMENTS

| | | | |
|---|---|---|---|
| GB | 2 277 906 | | 4/1993 |
| WO | WO 97/10144 | | 3/1997 |
| WO | WO 98/36800 | | 8/1998 |
| WO | WO 2004039188 | A1 * | 5/2004 |
| WO | WO 2004056223 | A1 * | 7/2004 |

* cited by examiner

BUOYANCY GARMENT

FIELD OF THE INVENTION

THIS INVENTION relates to buoyancy garments.

BACKGROUND ART

Despite there being many readily available and relatively inexpensive buoyancy aids, accidental death by drowning remains commonplace.

Most buoyancy aids are worn about the chest region of a wearer and most are bulky and very visible.

For some water sport activities such as surfing, kayaking, sailboarding and the like, participants are required to have a high degree of activity and arm freedom in order to participate freely in their activity and bulky or restrictive buoyancy devices are not favoured for this reason.

Another problem in terms of encouraging people to be more water safety conscious which affects young people in particular is the issue of image.

It is very rare to see a board rider wearing a buoyancy device even in treacherous conditions with the obvious conclusion from this that vanity issues are involved.

The more buoyancy devices can be disguised, the more likely they are to be accepted.

There have been numerous proposals for garment-type floatation devices and some proposals for add-on floatation devices worn in association with clothing.

Examples of purpose-built garment-type floatation devices are described in United Kingdom patent no. 2,183,554, U.S. Pat. No. 5,839,933, United Kingdom patent no. 316454 and U.S. Pat. No. 1,428,151.

U.S. Pat. No. 6,231,411 describes a fashionable lifesaving device which, it is said, utilizes the look of casual clothing such as shorts, pants, bathing suits or shirts to disguise inbuilt inflatable chambers.

International patent application no. PCT/AU98/00092 proposes an upper body supporting bladder which can be unobtrusively inserted under a garment such as a wetsuit to provide floatation support in an emergency situation.

It is an object of the present invention to provide a buoyancy device in the form of a common garment with a view to improved water safety.

A further object of the present invention is to provide a buoyancy device which is of fashionable appearance and insofar as is practicable, disguises the fact that it is a buoyancy device.

Further objects and advantages will become apparent from the ensuing description which is given by way of example only.

DISCLOSURE OF INVENTION

According to the present invention, there is provided in combination of a shirt and a floatation device comprising (a) a shirt having a continuous trunk, a collar and arm holes (b) a compartment formed from an inner lining or outer overlay which covers the chest and front and rear collar regions of the shirt, (c) means for providing access to the interiors of the compartment, (d) a removable bladder for insertion into the compartment, and (e) means for manual and/or automatic inflation of the bladder to provide floatation support for a wearer of the shirt.

Access to the compartment is provided by a closable openings positioned about the periphery of same.

The bladder can comprise two separate chest portions communicable with a collar encircling portion.

The collar encircling portion of the bladder can be narrower when viewed in plan than the chest portions.

The front side of the bladder can be provided with a value for manual inflation of the bladder and an actuator for automatic inflation of the bladder via a gas cylinder.

The valve and actuator can be hidden from view by pockets or flanges.

The shirt can be a tee or polo style shirt.

A captured wrap around tensioning device can be positioned just below the compartment.

The tensioning device can be a cord.

The tensioning device can include straps.

The tensioning device can be positioned to coincide with the lower rib region of the wearer.

The tensioning device can be positioned to coincide with the waist region of a wearer.

The closeable opening can be positioned at the rear of the shirt adjacent to the collar region.

BRIEF DESCRIPTION OF THE DRAWINGS

Aspects of the present invention will now be described with reference to the accompanying drawings in which.

Figure 1:
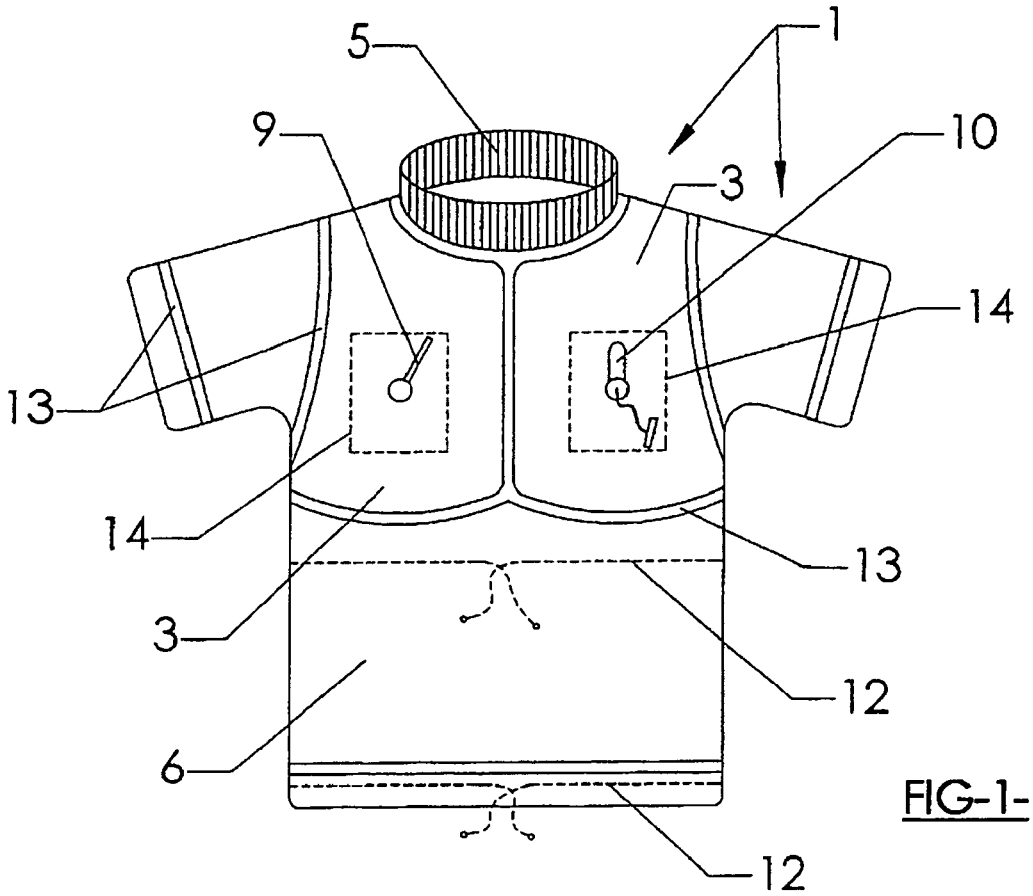
FIG. 1 is a front view of a buoyancy garment according to the present invention.
Figure 2:
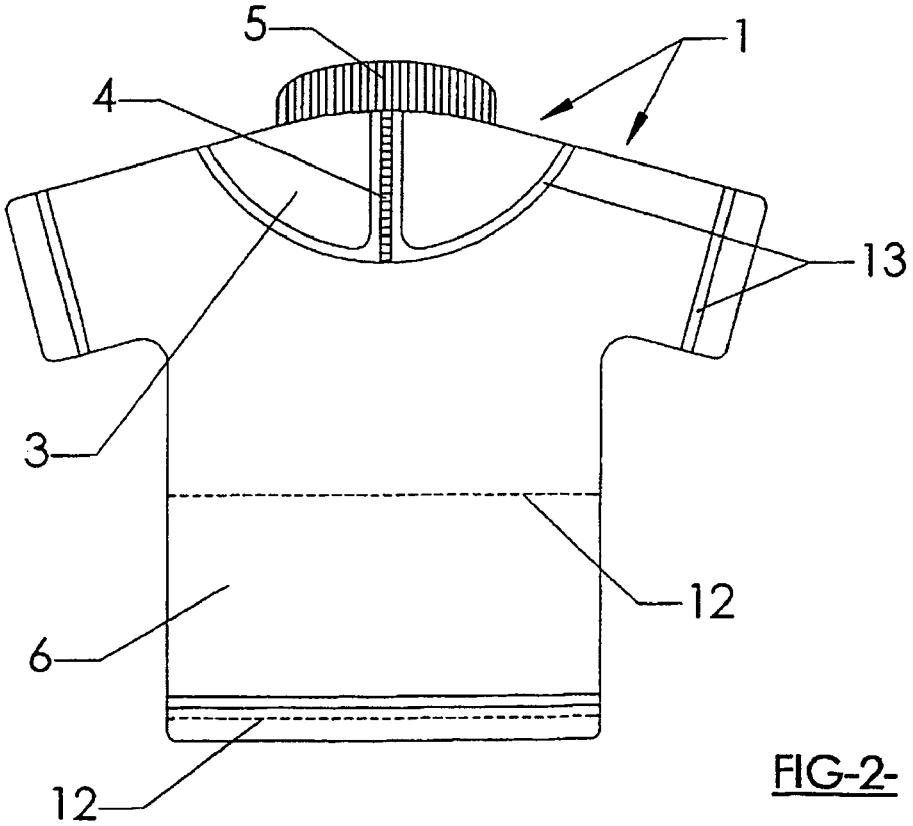
FIG. 2 is a rear view of the buoyancy garment of FIG. 1.
Figure 3:
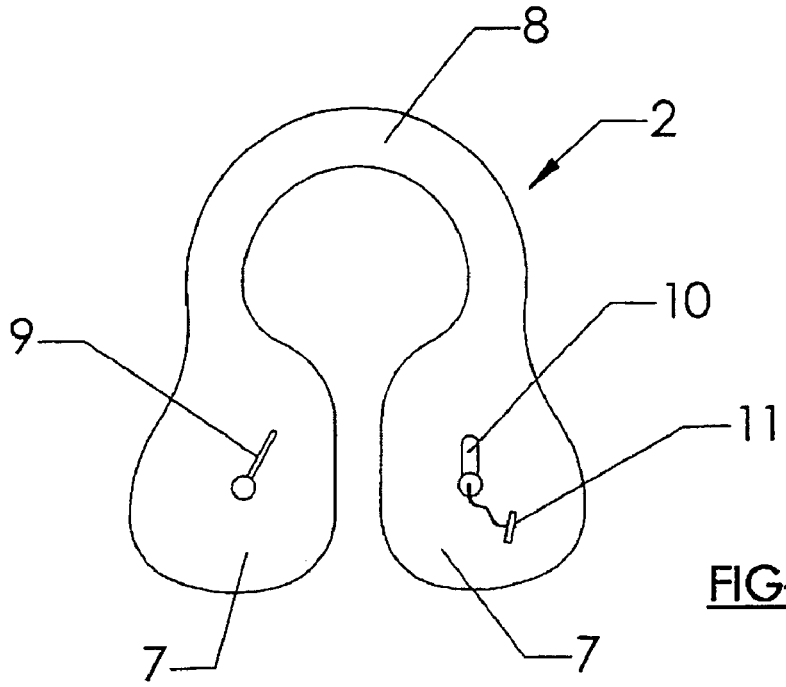
FIG. 3 is a plan view of a bladder for the buoyancy garment of FIGS. 1 and 2.
Figure 4:
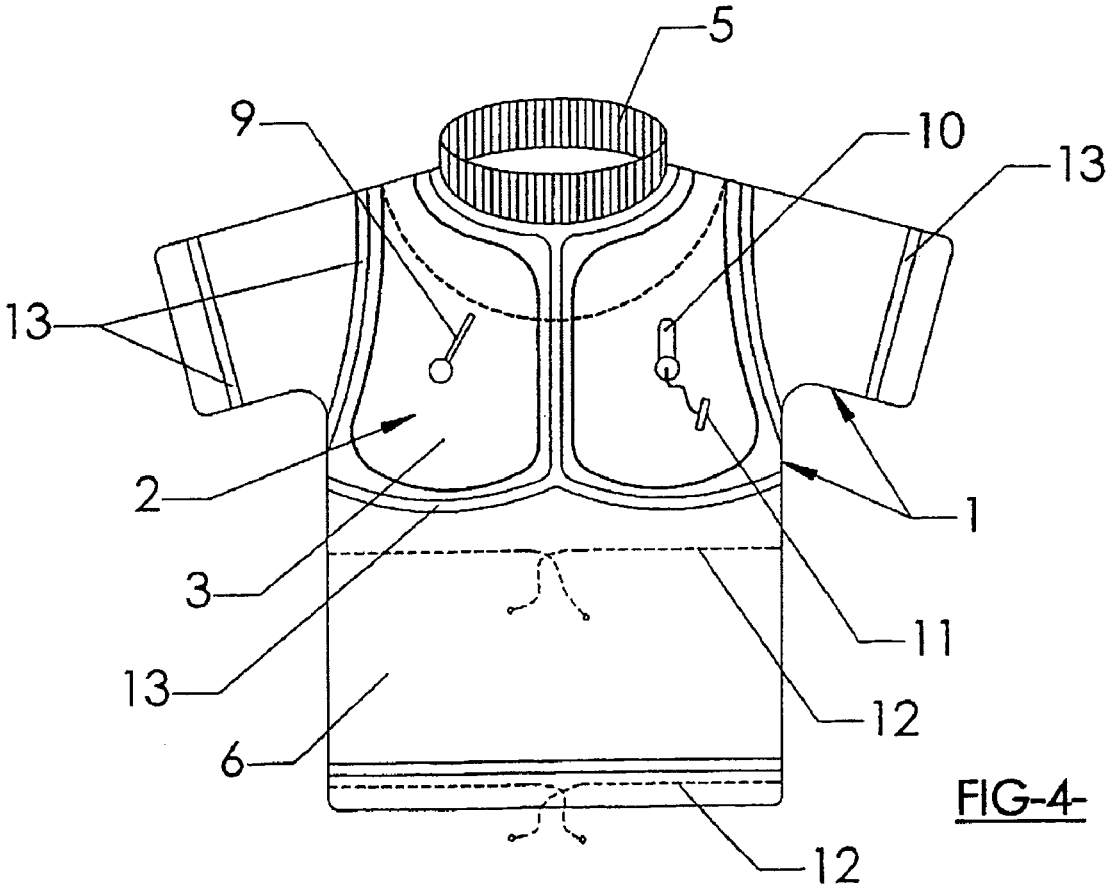
FIG. 4 is a front view of the garment showing for illustrative purposes the bladder overlaid in the garment.

With respect to the drawings, the buoyancy garment of the present invention comprises a combination of a shirt indicated by arrow 1 and a floatation device in the form of a bladder indicated by arrow 2.

The chest and shoulder region of the shirt provides a compartment 3 into which the bladder can be inserted, the compartment being formed by an inner lining or outer overlay.

In the illustrated example, the compartment is formed from an inner lining.

The garment is provided with an openable and closable opening 4 for inserting and removing the bladder from the compartment.

Other openings may be positioned about the periphery of the compartment.

The opening can be opened or secured with a zip, Velcro, studs or other suitable temporary closure means.

In the illustrated example an opening 4 is provided on the rear face of the shirt and extends between the collar 5 and trunk 6 of the shirt 1.

The bladder 2 and compartment 3 are of complementary shapes so that the bladder snuggly fits into the compartment.

The bladder 2 is provided with two separate chest portions 7 communicable via a neck encircling portion 8.

The bladder 2 is inflatable by inflation means which include a blow tube and one way valve 9 or an inflation gas canister 10 and activating cord 11.

The blow tube and canister are positioned on the chest portions 7 of the bladder to coincide with pocket positions on the shirt.

Tie cords 12 may be provided just below the rib area of the shirt and/or at the bottom hem of the shirt. The tie cords can be threaded into hems of the shirt. Belts may be substituted for the tie cords.

In line with the objectives of the invention to provide a fashionable clothing item which disguises the functional purpose of same, the shirt can be provided with decorative stripes 13 which coincide with the ends of the sleeves of the shirt and/or the hems fixing the underlay to the shirt and defining the outer periphery of the compartment.

The shirt can be made in any suitable fabric or material and in popular styles such as "tees" or "polos".

The bladder can be manufactured from plastics, UV resistant fabrics, PV coated nylon fabric, or nylon coated neoprene which can be stitched, glued or heat sealed or radio frequency welded.

Pockets or flaps 14 can be provided for disguising the blow tubes and gas inflation devices.

Figure 5:
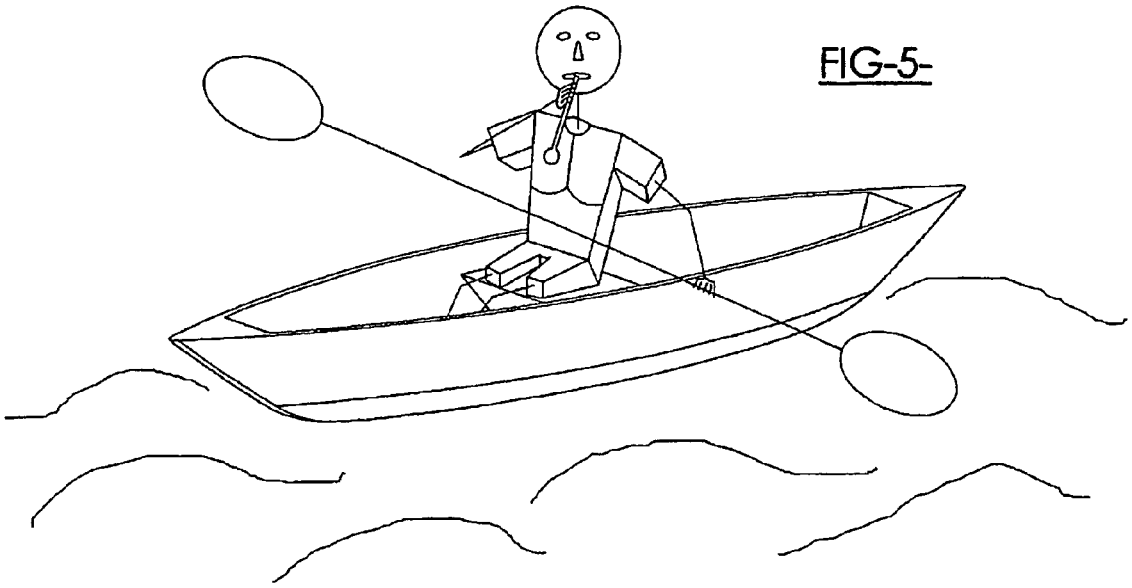
FIGS. 5 and 6 are perspective views showing a situation where a wearer may choose to self-inflate the bladder or, when in the water, activate a gas cylinder to achieve inflation.
Figure 6:
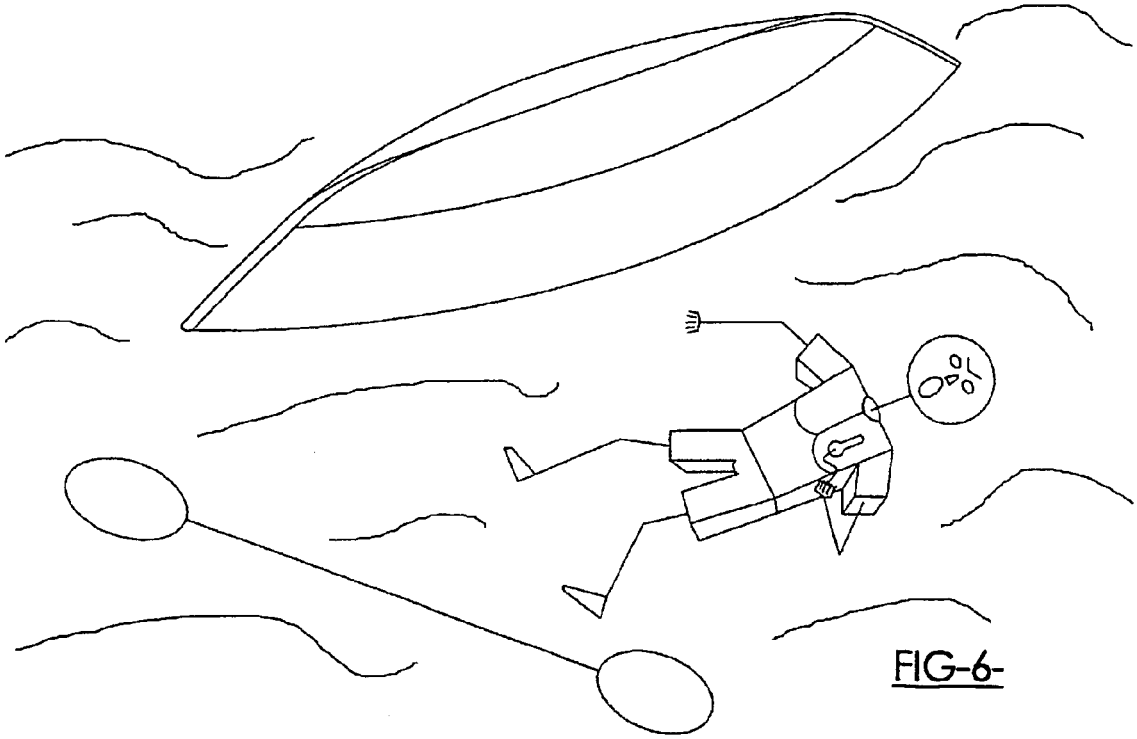

FIGS. 5 and 6 respectively of the drawings illustrate situations in which a user may wish to manually inflate the bladder in situations when unexpected danger occurs such as a large wave or rough seas and then an in-water situation where the user has fallen from a craft and the gas cylinder can be activated.

Because of the configuration of the bladder, the user will be provided with buoyancy support enabling him to either swim or float with the head well clear of water.

There are a number of advantages of the present invention including, inter alia, (a) the floatation function of the invention can be well disguised as a common place garment, (b) the bladder can be removed for maintenance and repair and to allow the garment to be separately cleaned, (c) inflation of the bladder can be achieved orally or in water situations with the assistance of a replaceable gas cylinder, (d) the invention can be produced at modest cost.

Aspects of the present invention have been described by way of example only and it would be appreciated that modifications and additions thereto can be made without departure from the scope of the invention as defined in the appended claims.

The invention claimed is:

1. The combination of a shirt and a floatation device comprising (a) a shirt having a continuous trunk portion adapted to extend over a person's chest, back and abdomen region, a neck opening and arm holes, the shirt unable to be entirely opened in the continuous trunk portion, and fitted to a person only by being pulled over the person's head, (b) a compartment in the shirt and formed from an inner lining or outer overlay and which is in the chest region and about the neck opening of the shirt, extending from the back region into the chest region by extending between the neck opening and each arm hole, (c) an opening in the rear of the shirt and adjacent the neck opening for providing access to the compartment, (d) an inflatable bladder device positioned in the compartment, and (e) means for inflation of the bladder, the means for inflation being positioned at the chest region.

2. The combination of claim 1 wherein the opening in the rear of the shirt comprises a zip which extends only partially down the rear of the shirt.

3. The combination as claimed in claim 1 wherein the bladder comprises two separate chest portions communicable with a neck opening encircling portion, the portions being in communication with each other.

4. The combination of claim 3 wherein said neck opening encircling portion of the bladder is narrower when viewed in plan than the chest portions.

5. The combination of claim 1 wherein the means for inflation of the bladder comprises a valve for manual inflation of the bladder and an actuator for automatic inflation of the bladder via a gas cylinder.

6. The combination of claim 5 wherein the valve and actuator are hidden from view by pockets.

7. The combination as claimed in claim 1 wherein the shirt has a collar.

8. The combination of claim 1 including a captured wrap around tensioning device positioned below the compartment.

9. The combination of claim 8 wherein the tensioning device is a cord.

10. The combination of claim 8 wherein the tensioning device includes straps.

11. The combination of claim 8 wherein the tensioning device is positioned to coincide with the lower rib region of the wearer.

12. The combination of claim 8 wherein the tensioning device is positioned to coincide with the waist region of a wearer.

13. The combination of claim 1 wherein the opening in the rear of the shirt is substantially equidistant from each arm hole.

* * * * *